US005788198A

United States Patent [19]

Sharpe

[11] Patent Number: 5,788,198

[45] Date of Patent: Aug. 4, 1998

[54] BRACKET FOR MOUNTING LADDER SHELF

[76] Inventor: Charles C. Sharpe, 3519 Mercer Ct., Slatington, Pa. 18080-3026

[21] Appl. No.: 606,444

[22] Filed: Feb. 23, 1996

[51] Int. Cl.[6] ..... E06C 7/14

[52] U.S. Cl. ..... 248/210

[58] Field of Search ..... 248/210, 238, 248/231.41, 231.61, 222.41

[56] References Cited

U.S. PATENT DOCUMENTS

| | | | |
|---|---|---|---|
| 2,895,700 | 7/1959 | Johnson | 248/210 |
| 3,182,749 | 5/1965 | Girardello | 248/238 X |
| 3,309,053 | 3/1967 | Baker | 248/210 |
| 3,310,271 | 3/1967 | King | 248/222.41 X |
| 3,710,096 | 1/1973 | McFarlin | 248/222.41 X |
| 3,853,202 | 12/1974 | Jarboe | 248/210 X |
| 5,060,755 | 10/1991 | Bourdages et al. | 248/238 X |

FOREIGN PATENT DOCUMENTS

| | | | |
|---|---|---|---|
| 797732 | of 1958 | United Kingdom | 248/222.41 |

*Primary Examiner*—Daniel P. Stodola
*Assistant Examiner*—Gregory J. Strimbu
*Attorney, Agent, or Firm*—Eckert Seamans Cherin & Mellott

[57] ABSTRACT

A bracket is attachable to a ladder to form a convenience support or other attachment that attaches to the rails or rungs of a ladder, and is readily reconfigured, moved or adjusted as to angular orientation, without substantial assembly steps or tools. The bracket has at least two and preferably three mounting members, each folded at a right angle to define two flat plates, e.g., with one of the plates longer than the other. Each plate has a least one array of spaced openings for fasteners. The fasteners and some of the openings are dimensioned so that the fastener heads or nuts fit through such openings of the plates and the shanks of the fasteners engage in a slot, which can require turning non-round fastener heads for alignment with the slot before insertion, and turning the non-round heads of the fastener back after insertion, or alternatively passing the head through a larger hole joined to the slot. The mounting members are attached in a chosen configuration by affixing the fastener in the first mounting member and attaching the second mounting member to the first mounting member by passing the hole of the second mounting member over the end part of the fastener and sliding the mounting members to arrange the shank in the slot of the second mounting member such that the plates interlock and engage around rails or rungs of the ladder, additional array openings are then chosen to receive fasteners for locking the orientation of the bracket.

6 Claims, 7 Drawing Sheets

BRACKET FOR MOUNTING LADDER SHELF

BACKGROUND OF THE INVENTION

1. Field of the Invention

The invention relates to the field of ladder brackets, and concerns a structure attachable to any type and size of conventional ladder for supporting a shelf or other article for the convenience of a person using the ladder, or to enable the attachment of various items such as scaffolding connections or workpieces that need to be held level and steady regardless of the angle at which the ladder rests.

2. Prior Art

An auxiliary support, platform or the like on a ladder is useful to provide ready access to equipment, materials, tools, etc. Safety, convenience and working speed are improved if users need not climb up and down repeatedly and instead have at hand what they need to do a job. Such a support is also useful as an available workspace for operations. For example, stepladders having pivoted front and rear legs usually are equipped with a shelf pivoted at the level of the next highest rung from the top or seat. The shelf can be folded closed to reside between and in the plane of the rear legs, or folded open to horizontal (provided the stepladder is opened out) for supporting a paint can or roller tray, tools, etc., at a level below the top rung or seat. The supporting part of the shelf extends rearward from its pivot axis on the rear legs (i.e., away from the user). Two extensions extend forward from the pivot axis and bear upwardly under the rung of the front legs when the ladder is pivoted open and the shelf is folded down to a position. Due to its mounting and placement, the conventional stepladder shelf is restricted as its size, and is fixed as to the position and angle at which it deploys. Although the shelf is apt for some jobs such as indoor painting, it would be advantageous if a more versatile arrangement could be provided that can be adapted to other needs and situations than the usual stepladder shelf.

Typically, a collapsible connecting member is foldably connected between the front and rear legs of a stepladder, and fixes the separation angle of the ladder legs. The front and rear ladder legs or rails open to a predetermined angle and the extensions of the opened shelf reach under a front rung at substantially the same elevation as the pivot axis. Thus the shelf is necessarily horizontal when deployed. Such a shelf is useful when the ladder legs are opened so the ladder is free standing, and the legs are fixed at their characteristic angle. When the stepladder is not folded open, for example being tilted against a structure while the legs are closed, the angle of the ladder is uncertain and is variable as a function of the distance between the structure and the foot of the ladder. In addition, the supporting structures for the pivoting shelf (i.e., the pivot and the rung) are not placed to interact as they do when the ladder is opened.

Extension ladders and simple ladders consisting of spaced side rails connected by rungs, are used at various, changeable angles of tilt, determined by the distance between the foot of the ladder and the structure against which the ladder leans, and the distance between the foot of the ladder and the point of contact with the structure. In different situations the ladder is set at different tilt angles. Unlike a stepladder, which is typically used in a situation where the shelf is in convenient arm's reach, an extension ladder or the like is often used in situations where the user needs to work all along the length of the ladder and not only at one height.

It would be advantageous to provide a convenient support device for any type of conventional ladder that is superior to a stepladder shelf in that it is not limited to a fixed size and/or position and that accommodates a variable ladder tilt angle. The support should be movably affixed to the ladder at any desired height, and either should remain horizontal, or better yet, should be positionable at any desired angle. However, it is disadvantageous to provide a large number of nuts, bolts and adjustments, especially requiring tools. Such adjustments are not convenient for a worker because they must be loosened, moved, tightened or otherwise attended to every time the support is moved up or down, and also whenever the tilt angle of the ladder is changed.

Examples of supports attachable to ladders are disclosed in the following patents:

| | | | |
|---|---|---|---|
| Des.284,513 | Dyer | 4,318,523 | Weatherly |
| 2,541,434 | Nelson et al. | 4,523,733 | Lunden, Jr. |
| 3,111,297 | Conner | 4,660,794 | Given |
| 3,229,943 | Olsen | 4,662,594 | Dubis |
| 3,822,846 | Jesionowski | 5,191,954 | Ledford |
| 3,829,051 | Emmons | 5,236,161 | Haven |
| 4,222,541 | Cillis | 5,342,008 | Kay |

As shown in these patents, an auxiliary support structure can be affixed to ladder rungs or to ladder side rails. For example, hook structures can extend over a rung and/or a clamp structure can grasp the rail or a rung. Insofar as the patents provide means for adjusting the angle of the auxiliary support structure, the adjustment typically involves releasing the platform to allow it to be moved to a new angle, where the platform is again locked. This may involve fasteners such as nuts and bolts, butterfly nuts, pins, clamps, levers, etc. The user of the ladder is required to hold the support in place while it is attached and configured. Thus the user may need to empty the support of tools, paint receptacles and similar work items so as not to spill them when releasing the support, and to make several trips up and down the ladder to remove such items, to disassemble, move, reassemble, position and lock the support, and to replace the work items needed to do the job.

It is counterproductive in a convenience support for a ladder to require tools or numerous assembly steps. It may be impractical for the user to effect all the necessary steps every time the ladder is moved. For example, a support for clamping to a rail may require the user to align two opposed clamping members, to insert a screw or bolt and attach a nut, then align the support to horizontal and tighten the nut and bolt to clamp the support in place, e.g., using wrenches. Where a support hooks over a rung, at least the angle must be adjustable if the support is to be set horizontal. If the user must empty the support of materials, obtain and use tools to build it again at another spot, and replace the tools and materials before getting back to work, the support is more trouble than it is worth.

Attempts to reduce reliance on parts that must be assembled and disassembled have had their own drawbacks. In the Lunden, Jr. patent, a support depends from a bar via a freely rotatable coupling. The attachment to the ladder is made by inserting the bar endwise into a hollow rung, with the support swinging below the bar. This is simple, but is correspondingly insecure, for example with nothing preventing the support from rocking. Dubis prevents rotation of a fitting inserted into a rung by using a lever controlled expandable fitting plug. Use of a clamping control lever is also found in Haven; however in Haven, as in others of the patents, no capability is provided to adjust the angle of attachment, e.g., as in Haven where a bowl shaped receptacle can confine articles even if tilted.

The user may desire to move the support without moving the ladder (e.g., the working elevation may be changed without changing the ladder tilt). It would be desirable in that case to have a support that can be easily and quickly detached and removed from the ladder, or relocated and reattached as a unit at a new position where it retains its previous angular orientation. Such a support could be moved up or down on the ladder without necessarily removing work items on the support. It would also be appropriate to enable quick and easy adjustment of the orientation, for use when changing the tilt angle of the ladder or reconfiguring the support.

What is needed is an optimal compromise between complexity and adjustability in a support. The support should not rely on structural connections and fasteners that are difficult to achieve or to adjust when on a ladder, should require no tools, and should be versatile as to the nature and location of its attachment to the ladder, as well as the particular angle assumed by the support.

SUMMARY OF THE INVENTION

It is an object of the invention to provide readily attachable and detachable flanged clamping elements that are capable of alternative attachments to a ladder such as a straight ladder, extension ladder or stepladder, and are highly versatile as to the position and placement on the rungs and/or rails and as to the relative angles between the clamping elements, rungs and rails.

It is another object to arrange a plurality of right angle folded plates with hole and slot arrays making the plates attachable simply and quickly to one another anywhere over a range of angles and spacings by which the plates are attachable to a ladder in various useful configurations.

It is a further object to provide a stable and secure interlocking arrangement for the plates, such that the plates are rigidly attachable to one another and to the ladder, thereby forming a stable and secure support that can nevertheless be readily detached, moved and reattached as needed, with or without changing the configuration of the attached plates.

It is also an object to provide a support that can be quickly configured, assembled or disassembled, for optimal convenience and security in placing the support on a given ladder or ladder configuration, for moving the support on the same ladder or for moving the support to another ladder or ladder configuration.

It is another object to provide hole and slot arrays for attaching clamping plates by passing them over the heads of fasteners through a hole that opens into a slot, and engaging a shank of the fastener in the slot to thereby affix the plates without the need to assemble separate fastener elements such as nuts and bolts.

It is still another object to provide an auxiliary support or attachment to a ladder that can be configured to encompass a wide or narrow clamping span, can attach to rails or rungs, and is useful for a wide variety of clamping and support functions.

These and other objects are accomplished by a bracket attachable to a ladder for providing a convenience support or point of attachment. The bracket can be affixed to the rails or rungs of a ladder, and is readily reconfigured or adjusted as to angular orientation, preferably using two leveling bolts and two clamping bolts that are easily installed or moved without the need for tools. For a ladder that remains at a given tilt angle, the bracket can be detached from the ladder and moved without substantial disassembly (e.g., to change elevation on a fixed-angle stepladder or an extension ladder that has not been moved). When changing the tilt angle of a ladder, minimal steps are necessary to adjust the bracket for the new angle. When adapting the bracket for a new type of supporting job, the bracket can be easily reconfigured by rearranging and interlocking its parts. The bracket comprises at least two and preferably three flanged or L-shaped mounting members, each folded at a right angle to define two flat plates. Preferably one of the plates is longer, e.g., twice as long as the other. Each of the plates has a least one array of spaced openings for fasteners. The fasteners are dimensioned to fit through the openings of the plates, and have a relatively narrower shank part and a relatively wider end part at least at one end of each fastener. The openings on the plates include a hole dimensioned to pass over the end part of the fastener, the hole being joined to a slot in the plate at least as wide as the shank part and narrower than the end part, such that the mounting members can be attached to one another in a chosen configuration by affixing a fastener in a first of the plates and attaching a second of the plates to the first plate by passing one of the holes of the second plate over the end part of the fastener and sliding the plates to arrange the shank in the slot of the second plate such that the plates interlock. Of two mounting members that clamp to a ladder, the two L-shapes are abutted directly at one of their respective plates and are spaced at the other pair of plates, which straddle around the side rail or rung of the ladder, and can be fixed by a pin. A plurality of spaced pins can abut the ladder, or more preferably, a single retaining pin is used for this purpose and only this pin needs to be removed temporarily to permit the bracket to be detached from the ladder and moved, for example to a new location or to assume a new tilt angle. The arrayed holes in the plates are such that certain of the holes will align to one another at various spacings and angles of the respective plates. Thus two spaced fasteners or pins can be placed at a required point in the array to achieve leveling, and/or a further L-shaped mounting member can be attached, for example to provide a horizontal or vertical surface as needed. In the event of a change in elevation or angle, or to attach to a different ladder, etc., the support simply can be easily and quickly detached, relocated (or removed entirely) and moved as a unit to the new position, angle or the like, with minimal disruption of work flow. This aspect is particularly useful when moving the support to a different elevation or to a similarly inclined ladder, in that the relative angles of the plates are kept intact.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the appended claims. In the drawings.

DETAILED DESCRIPTION OF THE PREFERRED EMBODIMENTS

Figure 1:
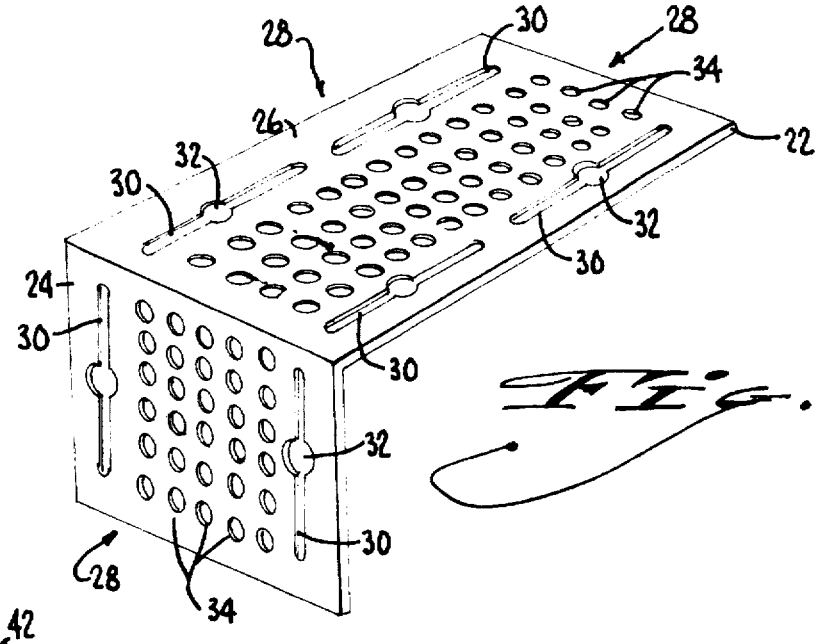
FIG. 1 is a perspective illustration of a basic L-shaped folded mounting member according to the invention, two or more of which are attachable to one another and to a ladder or the like according to the invention.

As shown in FIG. 1, a basic element of the invention comprises a flanged mounting member 22 that is generally folded into an L-shape of two flat plates 24, 26 connected at a right angle. Each of the plates 24, 26 has an array 28 of openings, including at least one elongated slot 30 that merges with a relatively larger hole 32, and a number of smaller holes 34 that are closely spaced in a regular array.

The smaller holes can have a diameter equal to the width of slot 30, but preferably the smaller holes are slightly larger in diameter than the width of slot 30 as needed to allow the non-round shoulder part of a carriage bolt to pass through a smaller hole 34 and then non-rotatably to engage in slot 30, as explained more fully below. In a preferred arrangement, for example, using a steel plate of at least 3/32" (2.4 mm) thickness, larger hole 32 is about 37/64" (14.7 mm) diameter as needed to pass a fastener head or nut; smaller holes 34 are about 23/64" (9.1 mm) diameter as needed to pass a fastener shank and preferably also a carriage bolt square shank section; and slot 30 is about 9/32" (7.1 mm), which will pass the carriage bolt square shank section only when aligned. Other specific materials, dimensions and configurations are also possible within the scope of the invention.

Three identical arrays 28 are provided in the embodiment shown in FIG. 1, each of the arrays having two slots 30 with larger holes 32 at the midpoint of the slots, surrounding a generally rectangular group of smaller holes 34. One such array 28 is disposed on a shorter one of the plates 24 and two arrays are placed side by side on the longer plate 26. In the preferred embodiment shown, smaller holes 34 are arranged in registry in a five-by-six array on the shorter plate 24 between two slots 30, and in a four-by-fifteen array on longer plate 26 between four slots 30.

The plates 24, 26 and hole/slot arrays 28 provide a wide variety of options by which two or more mounting members 22 can be joined together to provide alternative connections to the rungs 36 and/or rails 38 of a ladder, and according to a further aspect of the invention the plates are attachable by quick and convenient fastening means arranged to make secure and stable connections between the plates and so as to clamp the plates around a portion of the ladder. In this manner it is possible to support additional structures or to provide points at which further means can be attached to the ladder. The device is useful to provide convenience storage for tools, a support for a paint can or roller tray, a work surface or workpiece clamping surface and other similar conveniences that are readily attachable as well as removable and reconfigurable to adapt to a change in tilt angle or to moving the device as a unit to a new working elevation on the ladder.

Whereas plates 24, 26 have repetitive hole arrays, there are a variety of relative positions at which two of the arrays 28 can be aligned relative to one another such that two spaced openings in the arrays 28 line up, and can receive fasteners 40, thereby fixing the plates at that alignment. This may involve aligning spaced pairs of the smaller round holes 34 in the respective abutted plates of two members, aligning a hole 34 in one and a slot 30 in another, aligning two slots 30, or combinations of these. The connections are not limited to linearly aligned or right angle connections with the holes and arrays in registry, but also permit the plates 24, 26 to be linearly displaced and/or angled relative to one another as needed to accommodate a particular ladder structure, tilt angle and desired position for a supporting surface or connection.

Figure 2A:
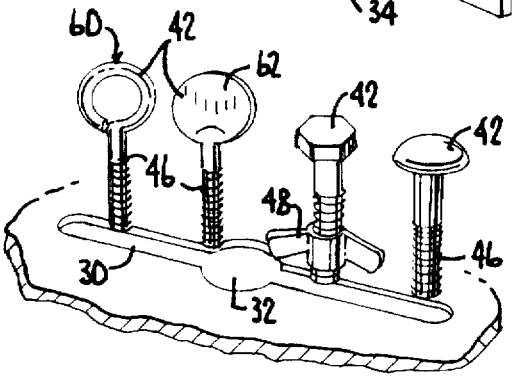
FIG. 2*a* is a partial perspective view illustrating several alternative types of fasteners, engageable according to the invention with a combined hole-and-slot opening in one or more of the mounting members.

The L-shaped mounting members 22 attach to the rungs 36 (horizontal steps) or rails 38 (lateral spaced normally tilted rung-supporting members) of the ladder using few or no tools, and minimal separable parts such as nuts and bolts. This is achieved in part by means of the hole and slot attachment arrangement shown in FIGS. 1, 2*a*–2*c*, 4, etc. One of several optional fastener types are used, each having a relatively wider head 42 (and also nut) and a relatively narrower shank 46. FIG. 2*a* shows examples, including a butterfly nut or wingnut 48 on a bolt placed loosely in one of the L-shaped mounting members 22. The end part of the fastener, in this case butterfly nut 48 but also possibly the head 42 on the other end of any of the depicted bolts, can be passed at least through the large central hole 32 in the corresponding hole and slot opening in the other L-shaped mounting member 22, whereupon the shank 46 of the fastener 40 is moved into the slot 30 as shown in FIG. 2*b*, to fix two mounting members 22 together by either of their plates 24, 26.

Any of a plurality of fasteners 40 can be used to fit through the openings of at least two such plates, the fasteners each having a relatively narrower shank part and a relatively wider end part at least at one end of each fastener, several examples being shown in FIG. 2*a*. At least one of the openings on each of the plates defines a hole 32 dimensioned to pass over one or the other end part of a fastener bolt and nut combination, such that it is not necessary to manipulate separate parts. Hole 32 is joined to slot 30 in the plate 24 or 26, the slot being at least as wide as the shank 46 and narrower than the head or nut, such that two mounting members 22 can be attached to one another in a chosen configuration by affixing a fastener 40 in a first of the plates 24 or 26 and attaching a second of the plates 24 or 26 to the first plate by passing one of their holes 32 over the end part of the fastener and sliding the plates 24, 26 relative to one another to arrange shank 46 in the slot 30 of the plate.

Figure 2B:
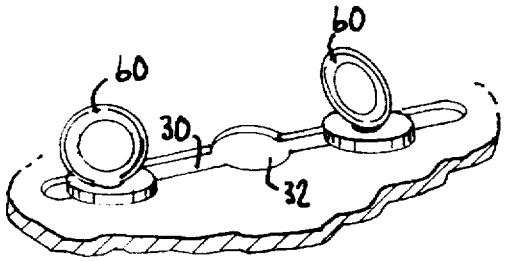
FIG. 2*b* is a partial perspective view showing attachment of two fasteners as in FIG. 2*a*.
Figure 2C:
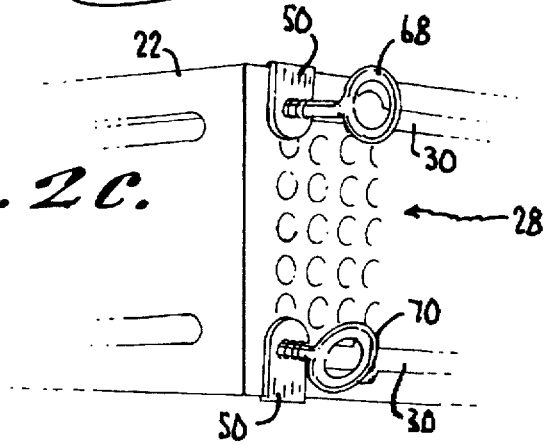
FIG. 2*c* is a partial perspective view showing an alternative embodiment in which the fasteners are threadable into U-nuts placed over edges of a mounting member.
Figure 3:
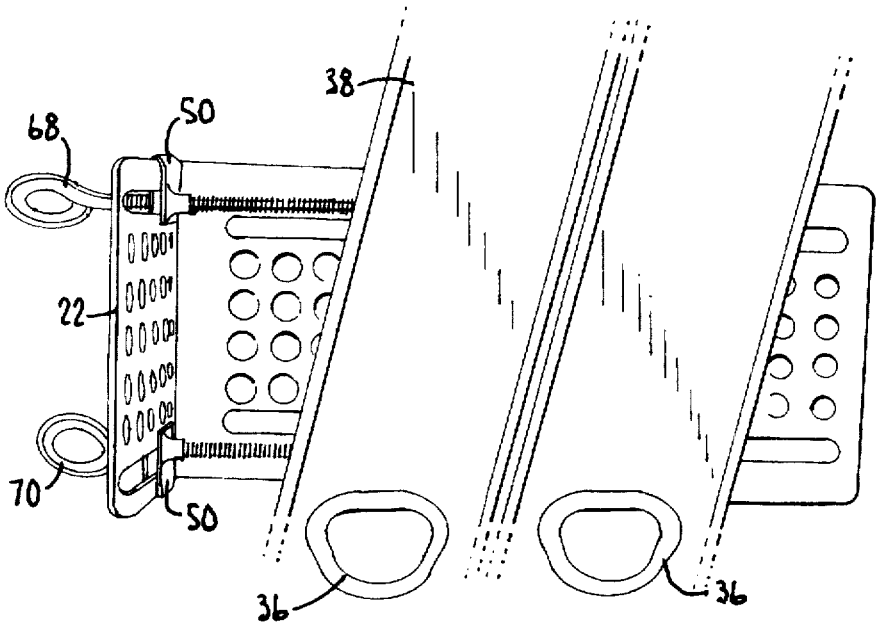
FIG. 3 is a partial side elevation showing use of the fasteners for adjusting the level of a mounting member relative to the tilt of an extension ladder.

In FIG. 2*b*, the eye part 60 of a fastener abuts against the panel and can have a washer to keep the eye part 60 from passing through the slot. In FIG. 2*c*, two eye fasteners 68, 70 are provided, but instead of the eye parts residing against the plate, each fastener is threaded through a U-strap that bridges around the edge of the plate such that fasteners 68, 70 can be threaded by a greater or lesser distance through the plate, for example as a means for levelling, as shown in FIGS. 3 and 4.

Figure 4:
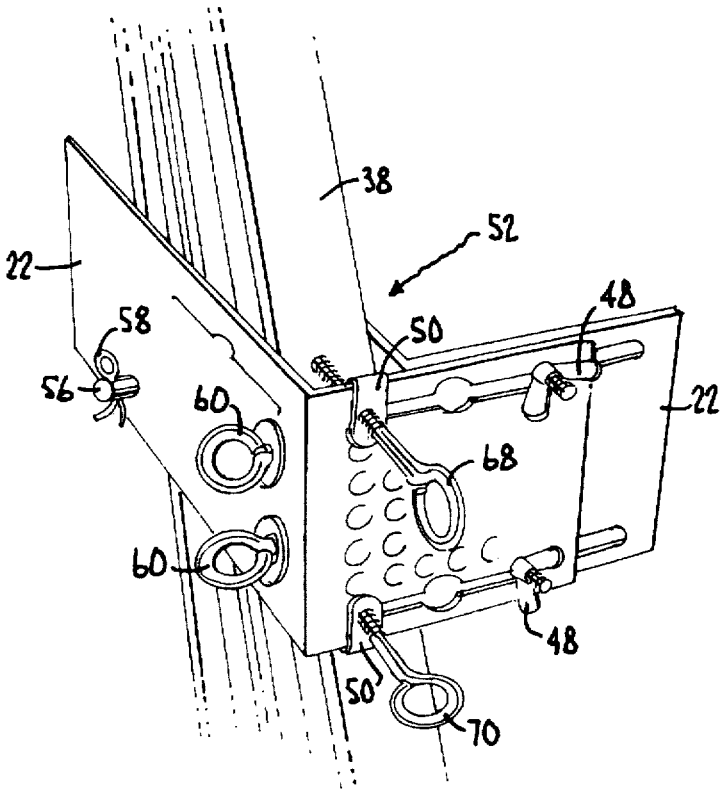
FIG. 4 is a partial perspective view showing a pair of brackets clamped to a stepladder leg and leveled as in FIG. 3.
Figure 5:
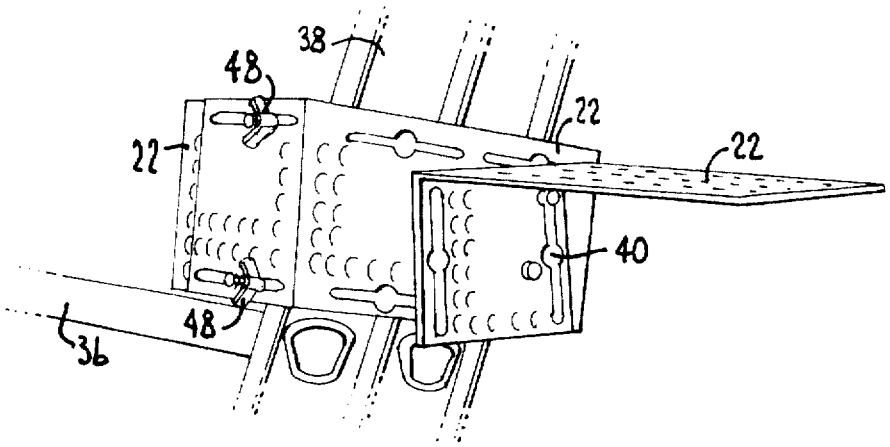
FIG. 5 is a perspective view showing three mounting members clamped to the side rails of an extension ladder, with a horizontal surface leveled in part by the positioning of one of the mounting members relative to a pair of a clamping mounting members.
Figure 6:
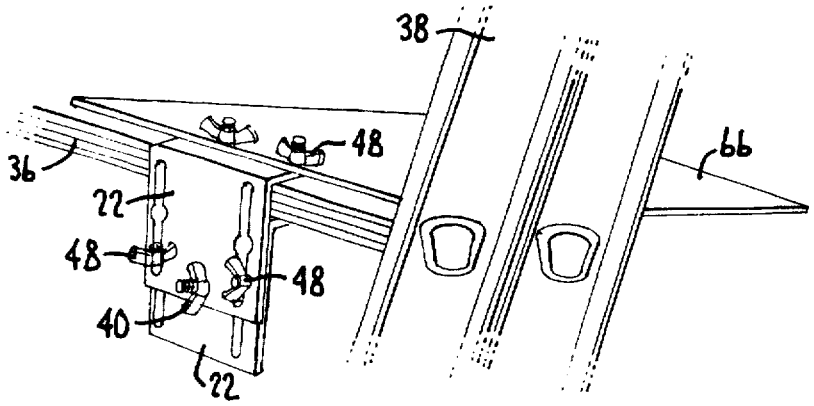
FIG. 6 is a perspective view showing an alternative form of platform using two mounting members and a flat plate, attached to the rungs of an extension ladder.

As also shown in FIG. 4, two L-shaped mounting members 22 can be attached directly at an abutting pair of the plates 24, and are spaced between the other pair of plates 26, which are straddled over one of the rails or rungs 38, 36. In FIG. 4 the device is attached to an inclined leg of a stepladder 52 and is levelled by fasteners 68, 70 in threaded U-straps 50. Wingnut fasteners 48 affix the abutting plates and the spaced plates are attached by eye fasteners 60. A fastener pin 56 extends through the spaced plates 26 for securing the L-shaped mounting members 22 to the ladder such that the device can be detached as a unit and moved simply by removing the pin. For example pin 56 (or alternatively a bolt) is inserted as shown in FIG. 4, on one or both opposite sides of the ladder leg 38 from the connected plates 26. The pin can comprise an unthreaded shank which has a lateral hole for a spring clip 58, cotter pin or the like to hold the pin captive and thus to keep the bracket in place on the ladder. The spring clip can be tethered to the pin by a wire or chain (not shown). In a preferred arrangement, pin 56 comprises an adjustable clevis pin, hairpin cotter and/or bridge pin, the pin having axially spaced lateral holes that provide for a choice of axial spacing between the head of pin 56 and a lateral locking clip or cotter that is tethered by means of tether 59 to the pin 56, for example at a ring attached to or under the head (not shown). Additional plates that are flat or L-shaped can also be attached to this basic structure of two L-shaped members attached to the ladder or the like, as shown in FIGS. 5–7.

Figure 7:
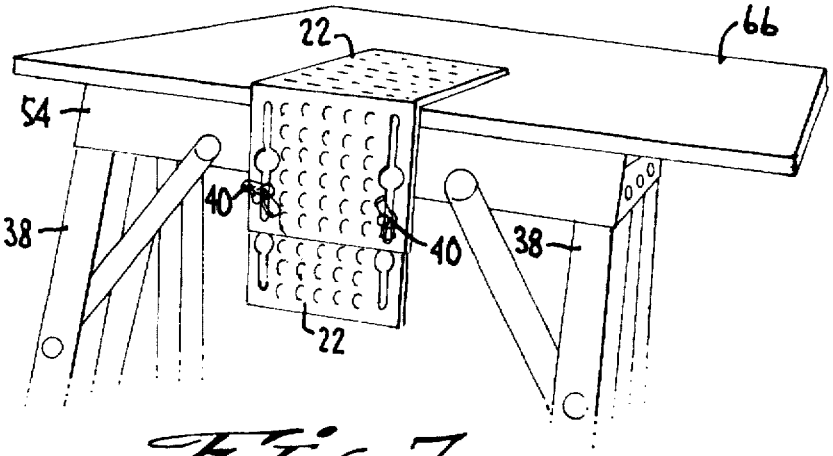
FIG. 7 is a side elevation showing attachment of the bracket as in FIG. 6 to the top rung or seat of a stepladder.

Each of the plates 24, 26 of the L-shaped mounting members 22 has at least two hole and slot openings 30/32, which can be aligned to clamp around a ladder rail (FIG. 5) or rung (FIG. 6) or elsewhere such as the stepladder seat 54 in FIG. 7. In FIG. 5, in order to fix the bracket at a desired angle relative to a tilting ladder component such as the rail of a ladder tilted against a structure, the array of openings includes the circular holes 34 that are smaller than the end portions or heads and nuts of the fasteners 40, and larger than the shanks 46 of the fasteners. The circular holes 34 are provided in a pattern of columns and rows. By placing two spaced fasteners 40 through holes and/or slots that line up when the mounting member is in position (for example to provide a horizontal surface), the mounting member is mounted in position.

The bracket as shown can be configured to attach to any ladder whose total side rail width does not exceed seven inches (17.8 cm), a standard maximum width in a retracted extension ladder (FIG. 5) having two adjacent rails being six inches (15.2 cm). By choice of plate alignments and the attachment holes employed, and/or by set-screw like levelling screws as in FIGS. 3 and 4, the relative angles between a nominally horizontal or vertical plate surface and the tilt of the ladder can range in the necessary arc. A ladder tilt of 55 to 70 degrees relative to horizontal is the normal range of ladder tilt, for considerations of safety, and can be readily accommodated in this manner.

The fasteners 40 can comprise simple bolts with heads 42 or nuts that are larger than slots 30 but smaller than holes 32 in the hole/slot openings. Referring to FIG. 2*a*, however, fasteners that are made to be tightened without wrenches are particularly apt for the bracket of the invention. Such fasteners advantageously have end parts (either head 42 or the associated nut) with an unequal length and width as needed for being tightened manually using the fingers only. Examples as shown in FIG. 2*a* include an eye bolt 60, thumb screw 62, the above butterfly nut bolt 48, and a carriage bolt having a non-round section of shank adjacent to the head.

For eyebolts, thumbscrews, butterfly or wing nuts and the like, the radial size of the end part of the fastener along its longer dimension is greater than the width of slot 30, but the width of the end part is less that the width of slot 30. Thus the fastener can be aligned to the slot and inserted anywhere along the length of the slot and not only at hole 32, then being turned 90° to lock in slot 30 in the same manner as a fastener with a different shaped head (e.g., with a hex nut or a hex or round head) is locked by first passing the head through central hole 32.

Figure 8:
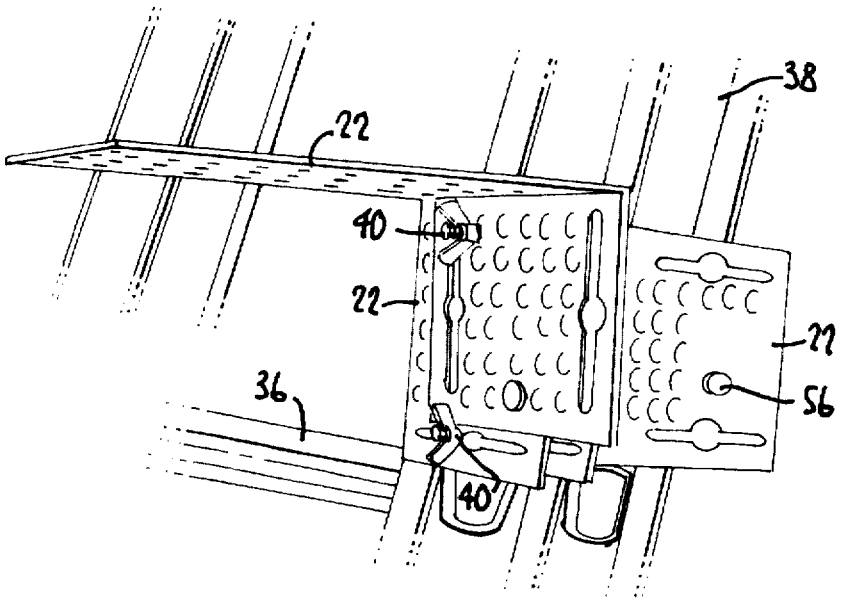
FIG. 8 is a partial perspective view illustrating attachment of the bracket of the invention to the side rails of an extension ladder to provide a forward shelf.
Figure 9:
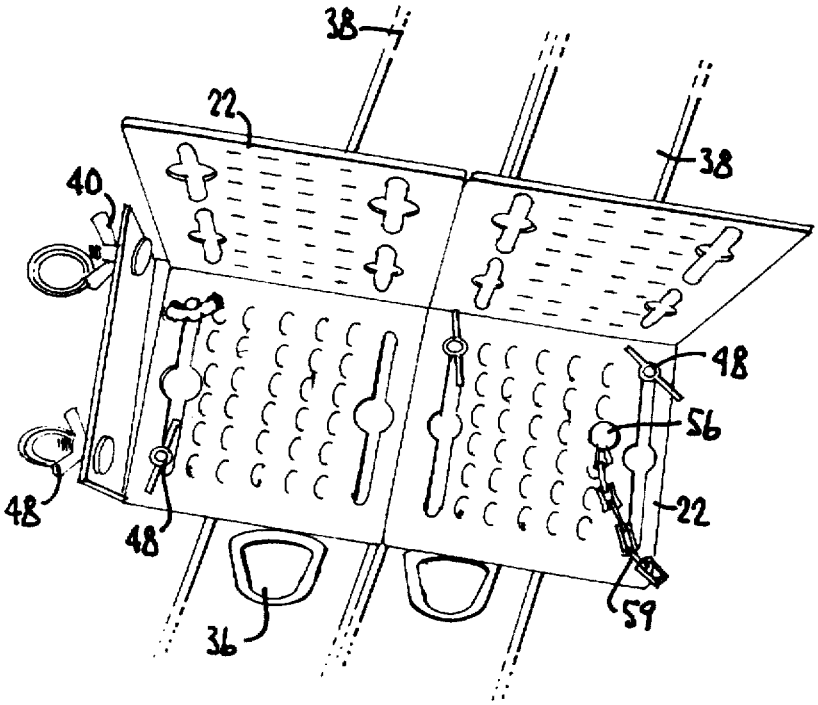
FIG. 9 is an elevation view showing the bracket on extension ladder side rails to provide a double width lateral shelf.

Preferably, L-shaped mounting members 22 are attached by one pair of their plates 24, 26 directly abutting facewise, and a second pair of the plates being spaced for clamping around a portion of the ladder as shown, for example, in FIGS. 7 where the spaced plates enclose the seat of stepladder. In FIG. 8, the mounting members have been turned to clamp on the inside and outside surfaces of ladder rails 38 and have been levelled as described. A third L-shaped bracket or mounting member can be provided to attach to the inner or outer mounting member for providing a horizontal surface or shelf extending outwardly. In FIG. 8, the shelf extends forward toward a user on the ladder. In FIG. 9, the shelf is provided using two adjacent plates and extends laterally outwardly. A similar shelf or horizontal surface can extend laterally inwardly between rails 38 or rearwardly toward the structure against which the ladder is tilted. Extension ladders are often designed so that when retracted the rungs at each level are at the same height, providing a wider stepping area, and the bracket of the invention can encompass both, as in FIG. 6.

The bracket of the invention does not rely wholly on inward clamping pressure or on mounting on a flat surface to maintain the orientation of the bracket and any shelf or similar associated fixture. Reliance on clamping pressure normally would require wrenches and the like to tighten the arrangement sufficiently to support, for example, a full gallon paint can on a surface that is cantilevered from the point of clamping to the ladder. A horizontal structure such as the wide stepladder rung or seat as in FIG. 7, can support a weight cantilevered out from the point of attachment to the ladder, because the bracket of the invention is constrained. It is also arranged to maintain horizontal and perpendicular surfaces notwithstanding its mounting on rails that are tilted or even splayed. In FIG. 5, a shelf is attached to one of the brackets of the invention to enlarge the available space. Such a shelf can comprise a wooden, metal or plastic plate, with or without additional fastener openings, and also can be simply clamped without fasteners between the plates and the ladder rung or seat. Similar additional plates can be attached horizontally, vertically or at an angle using fasteners where required, for example to mount a pegboard on which tools can be hung.

In various of the configurations shown in the drawings, a weight placed on the support surface of the bracket would tend to rotate it unless clamped tightly. According to the invention as shown, for example, in FIGS. 8 and 9, a bolt or pin 56 can extend through the bracket, at a position to block rotation without tight clamping. The right angle corner of one of the plates can contact a ladder side rail, or an outer edge of a plate can contact a rung. Pin 56 prevents rotation of the bracket by fixing a point spaced from the point of such contact relative to the ladder rail. The points of contact keep the bracket and its shelf horizontal although the ladder rail is tilted. No tight clamping is needed, and the bracket can be easily detached and repositioned.

The invention is widely applicable to various sizes of ladder rail and various configurations of attachment, because the array of holes 34 and hole/slot openings 30/32 provide the user with numerous potential bolt or pin entries. The user chooses available holes in the array that most closely align with the upper front and lower rear points of contact with the side rail, and places the bolts where needed. This maintains the position of the auxiliary shelf.

The L-shaped mounting members can vary with respect to the specific placement of the smaller holes 34 and the large holes 32 along slots 30. For example, slots 30 are parallel and located along the extreme edges of the plates in the embodiments shown, but could be spaced inwardly or otherwise oriented relative to one another. In any event, the heads of the fastening bolts or their nuts can be passed through the hole/slot opening without removing the nut and bolt from one another. Thus, eye bolts, thumbscrew bolts, butterfly nuts and the like are particularly useful.

Figure 10:
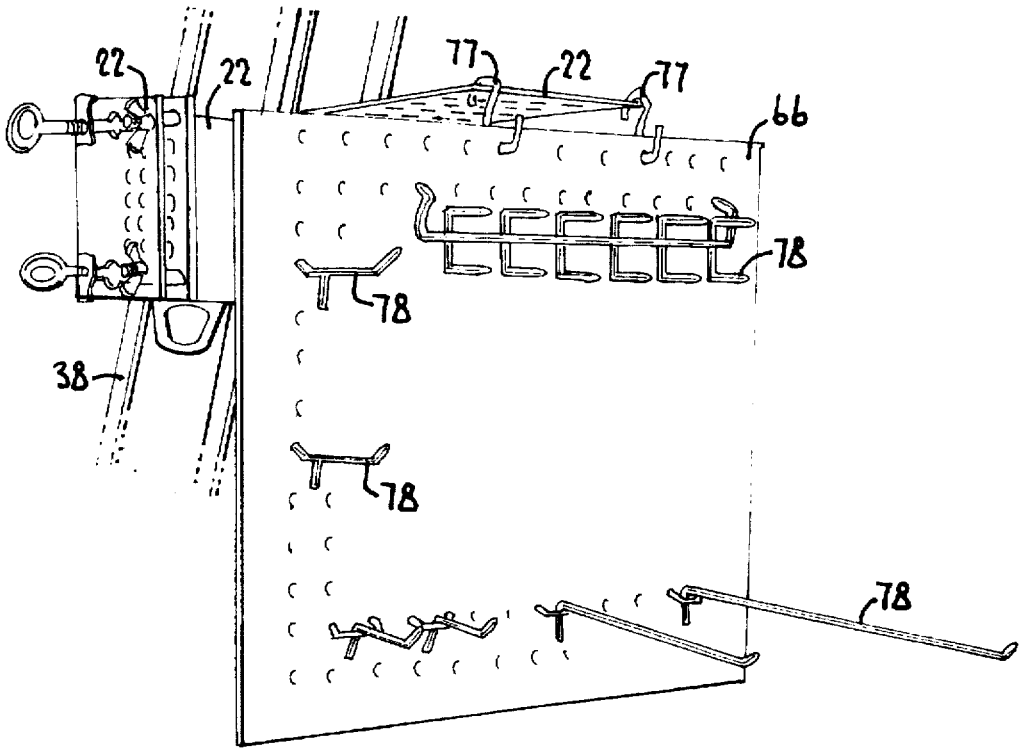
FIG. 10 is an elevation view showing use of the invention to support a pegboard for tool holders.
Figure 11:
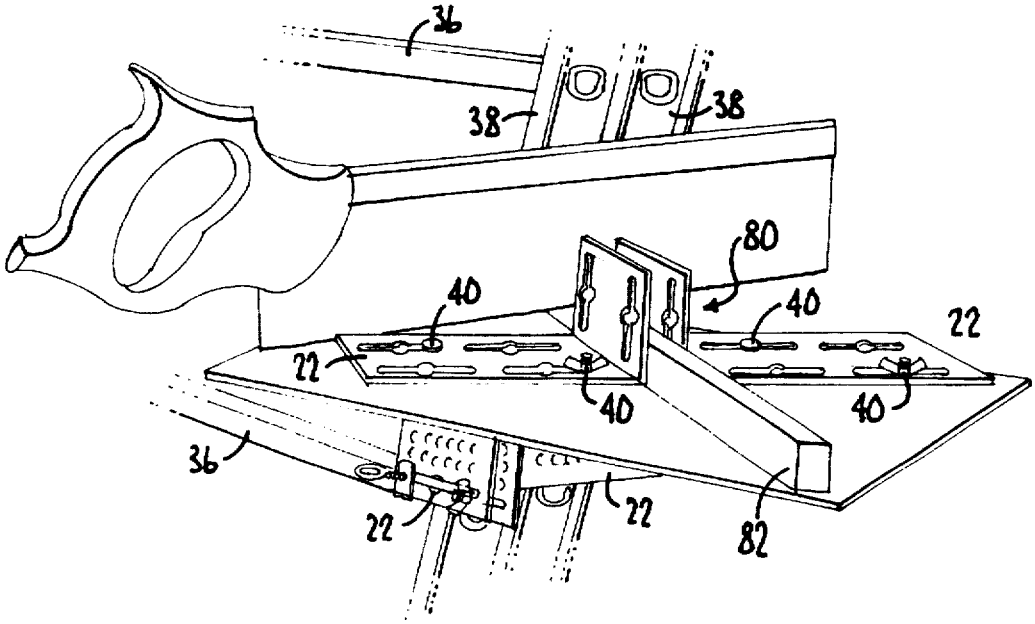
FIG. 11 is a perspective view illustrating use of the device as a workpiece support.

FIGS. 10–15 show various uses of the invention. In FIG. 10, a flat pegboard plate 66 is carried by hooks 77 in a vertical orientation to hold tools or tool receptacles 78. In FIG. 11, a plate in a horizontal orientation the plate is useful to support tools or to provide a surface to receive a workpiece 82. Additional L-shaped bracket parts 22 can provide a restraint 80 for the workpiece. Plate 66 can have a similar arrangement of hole arrays and hole/slot combinations dimensioned the same as L-shaped mounting members 22, likewise providing a variety of options for precisely how and where the plate is mounted. Alternatively, a more generic shelf plate can be used, preferably having at least some holes spaced to complement those of the L-shaped plates for receiving fasteners whereby the plate is readily and quickly mounted or removed.

Figure 12:
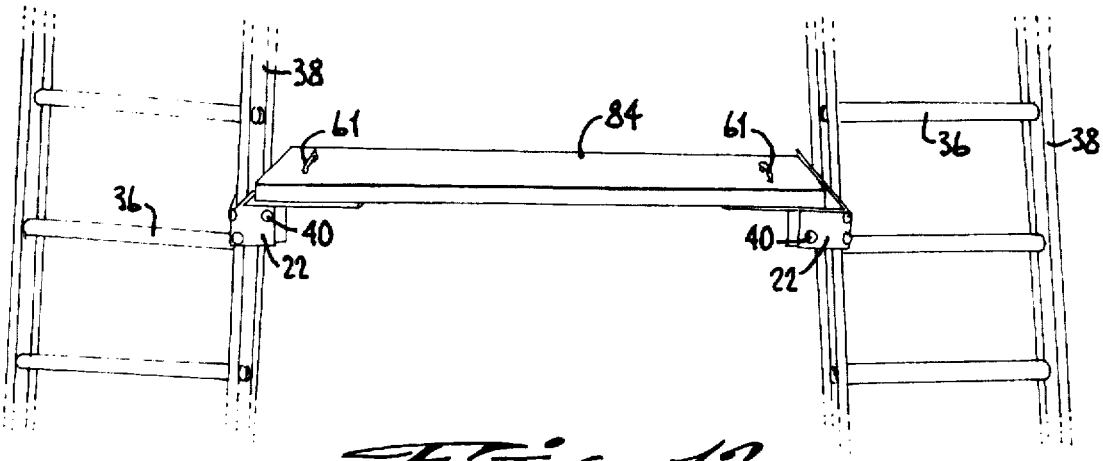
FIG. 12 shows use of two supports and ladders in a scaffolding arrangement with a horizontal connecting member.
Figure 13:
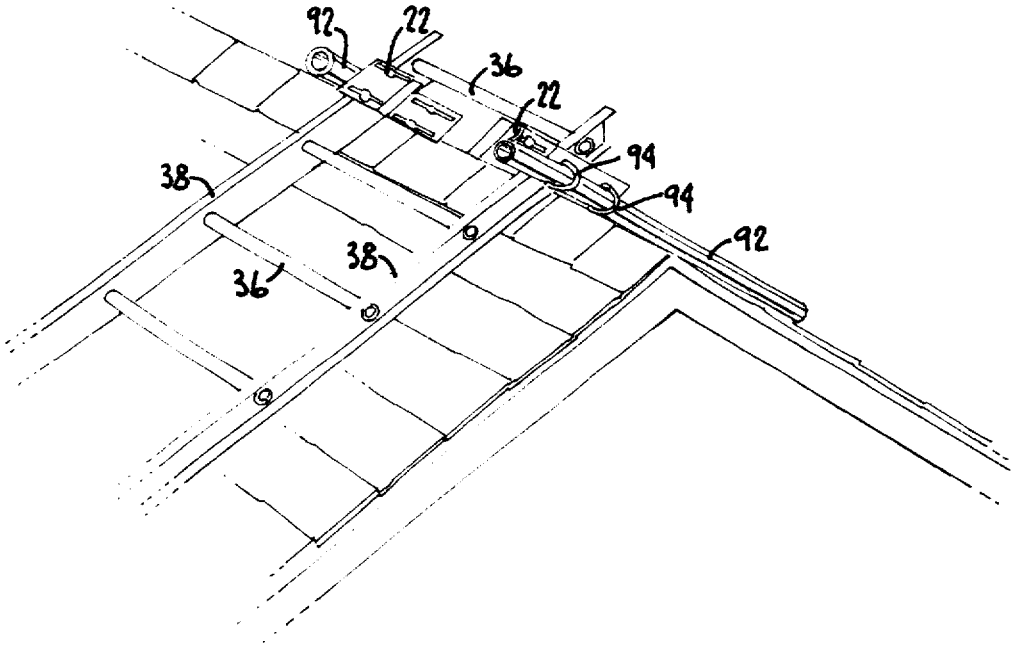
FIG. 13 shows use of the bracket to engage supports extending over the peak of a roof.

FIGS. 12–15 show some further uses. In FIG. 12, brackets on spaced ladders each connect to a horizontal beam member 84 that forms part of a scaffold-like arrangement wherein member 84 bridges between the brackets. Additional fasteners and/or fixtures 61 can be used to obtain a secure connection between the various parts. In FIG. 13, two bracket arrangements on the end of a ladder attach to pipes 92 using U-bolts 94. The pipes are arranged at an angle relative to the ladder rails for hooking over the peak of a gable roof.

Figure 14:
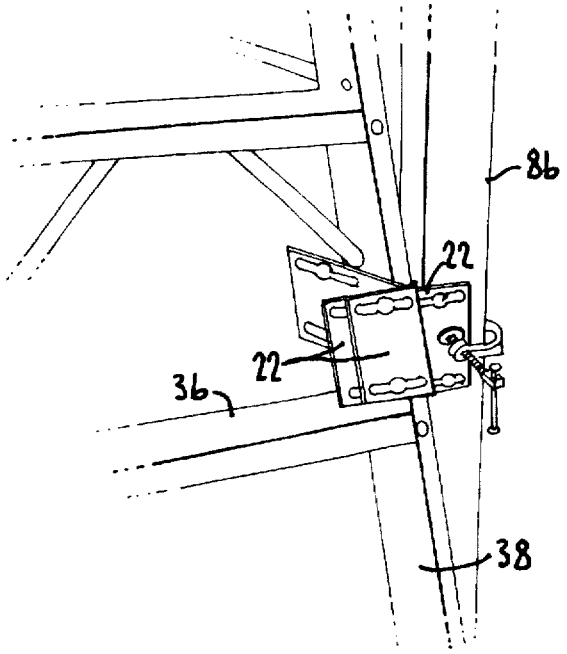
FIG. 14 shows use of the bracket to engage a vertical support member.
Figure 15:
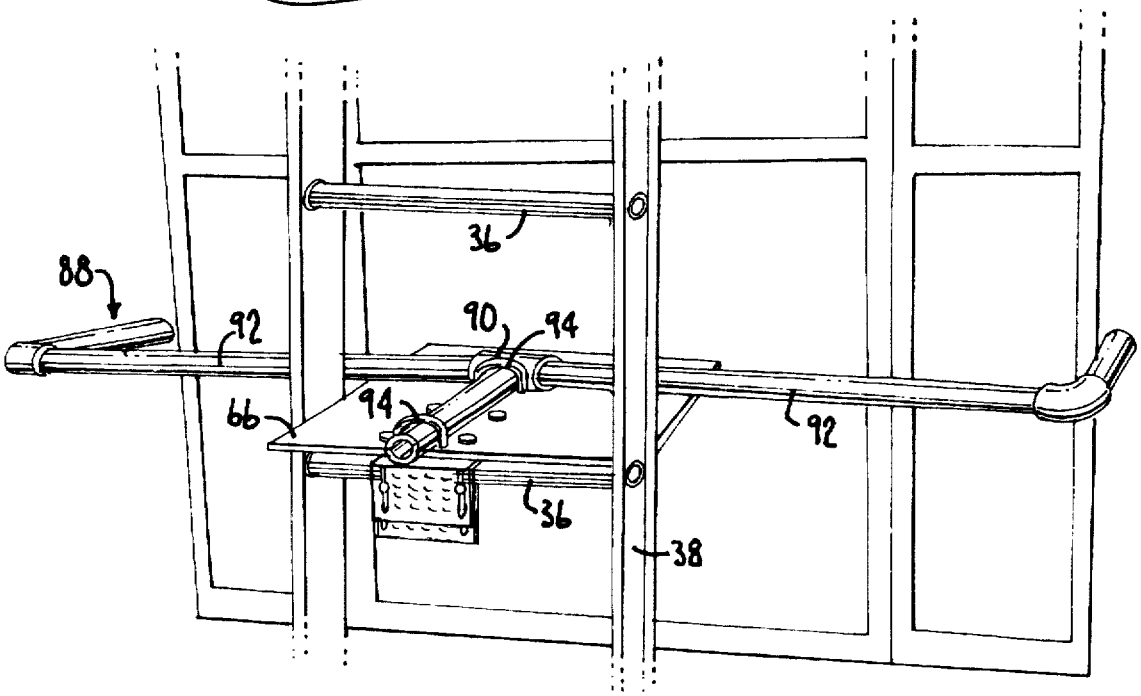
FIG. 15 illustrates use of the support to carry lateral stabilizing means.

In FIG. 14, a vertical post 86 is provided and clamped to the bracket of the invention, which is in turn attached to the ladder. In FIG. 15, an arrangement 88 of pipes 92 is coupled to the ladder using U-bolts 94 as in FIG. 13, coupled to a plate 66. In this case the pipes 92 extend laterally and forward such that the ladder can be tilted toward a window, and the pipes straddle the window. A third horizontal plate 66 between rungs is used to carry a PVC stabilizing pipe structure 88 having a central tee 90 and lateral arms 92, the arrangement being affixed to plate 66 with U-bolts 94. The lateral arms 92 can bear against a structure, such as the walls on either side of a window. This arrangement is useful in that the ladder need not be retracted to rest against the window sill or extended well above the window to rest against the wall. Additional variations will also now be apparent.

The L-shaped members can comprise stamped steel plate and can be painted, coated with rubber or plastic, or otherwise treated or made of a material free of rust and corrosion. The thickness or gauge of the plate material is a function of the intended use. For light duty use (e.g., household), 3/32" (2.4 mm) thickness is adequate for support of paint cans, incidental tools and the like. For medium or heavy duty use, a 1/8 to 1/4" (3.2 to 6.3 mm) thickness plate is preferred. To enable a lighter and less expensive material, the edges of sheet material plates can be rolled to stiffen them. Another light duty material is injection molded plastic; but for plastic the thickness must be increased and/or flanged edges may be appropriate.

According to the embodiments shown as examples, typically a single horizontal or vertical portion of an L-shaped plate is the ultimate "working member" that is fixed relative to the ladder. The invention is also applicable to arrangements in which a plurality of such working members are affixed to the ladder. For example, two or more horizontal members can be mounted at a space to define vertically spaced shelves, shelves that protrude oppositely, etc. Combinations of horizontal and vertical plates, attachments to other structures and the like are all made possible because any two of the L-shaped plates of the invention are readily and conveniently attached anywhere over a range of relative positions and angles. Thus the structure can be readily set up, moved or removed, reconfigured and otherwise adapted to the job at hand, using minimal assembly steps, fasteners and inconveniences.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A clamping bracket for attaching an auxiliary structure to a ladder, comprising:

a first mounting member and a second mounting member, each of the mounting members having a first plate and a second plate joined at a common edge and defining an angle between the first and second plates, the common edge of the second mounting member being nested within the angle defined by the first mounting member;

means for adjustable attaching the auxiliary structure, said means secured to at least one of the mounting members, wherein one of the plates of the first mounting member is removably secured to one of the plates of the second mounting member; and, a third mounting member removably secured to one of the first and second mounting members in a substantially horizontal orientation irrespective of an orientation of the first and second mounting members.

2. A clamping bracket for a ladder for use in front of a window, the bracket comprising:

a first mounting member and a second mounting member, each of the mounting members having a first plate and a second plate joined at a common edge and defining an angle between the first and second plates, the common edge of the second mounting member being nested within the angle defined by the first mounting member;

a third horizontal plate removably secured to one of the first and second mounting members; and, an arrangement of pipes, the pipes positioned to form a tee with a central section secured to the third horizontal plate and with lateral arms extending outwardly from the central section, wherein the lateral arms are adapted to be laterally spaced from and extend forward of the ladder, whereby the lateral arms are adapted to straddle and engage around the window when the ladder is tilted toward the window.

3. A clamping bracket for a ladder comprising:

a first mounting member and a second mounting member, each of the mounting members having a first plate and a second plate joined at a common edge and defining an angle between the first and second plates, the common edge of the second mounting member being nested within the angle defined by the first mounting member;

one of the plates of the first mounting member being removably secured to one of the plates of the second mounting member;

a plurality of fasteners for securing the mounting members relative to each other, the fasteners having heads and shanks extending from the heads, each of the mounting members having an array of apertures therein, said apertures having diameters at least as large as a diameter of the shanks and smaller than a diameter of the heads of the fasteners, at least two of said fasteners adapted to be placed through said apertures of both said mounting members to fix the position of the bracket relative to the ladder;

an auxiliary structure adjustable attached to at least one of said mounting members;

wherein the auxiliary structure has a portion defining a work area;

wherein the clamping bracket further comprises a means for securing the work area in a substantially horizontal position irrespective of the orientation of the mounting members, whereby the first plates are adjustably spaced from each other so as to straddle a portion of the ladder and the second plates are positioned in contact with each other;

whereby the auxiliary structure is adapted to be positioned near the ladder when the clamping bracket is secured to the ladder.

4. The clamping bracket as recited in claim 3, wherein said work area comprises a shelf.

5. The clamping bracket of claim 3, further comprising means for securing the auxiliary structure at any angular orientation relative to the mounting members.

6. A pair of clamping brackets for use with a pair of ladders and a beam, each of said clamping brackets comprising:

first, second, and third mounting members, each of the mounting members having a first plate and a second plate joined at a common edge and defining an angle between the first and second plates, the common edge of the second mounting member being nested within the angle defined by the first mounting member;

one of the plates of the first mounting member being removably secured to one of the plates of the second mounting member;

the third mounting member attached to at least one of the first and second mounting members in a substantially horizontal orientation irrespective of an orientation of the first and second mounting members;

whereby when each clamping bracket is secured to a corresponding one of the ladders with one of the plates of the third mounting member being positioned substantially horizontally and the beam is disposed on the substantially horizontal plates of each of the third mounting members and extends between said clamping brackets, a scaffold is formed.

* * * * *

UNITED STATES PATENT AND TRADEMARK OFFICE

CERTIFICATE OF CORRECTION

PATENT NO. : 5,788,198

DATED : August 4, 1998

INVENTOR(S) : Charles C. Sharpe

It is certified that error appears in the above-indentified patent and that said Letters Patent is hereby corrected as shown below:

Column 10, Claim 1, line 53, delete "adjustable" and substitute therefor --adjustably--.

Column 11, Claim 3, line 34, delete "adjustable" and substitute therefor --adjustably--.

Signed and Sealed this

Twenty-sixth Day of January, 1999

*Attest:*

*Attesting Officer*

*Acting Commissioner of Patents and Trademarks*